United States Patent [19]

Pickard

[11] Patent Number: 4,911,447

[45] Date of Patent: Mar. 27, 1990

[54] RANDOM SELECTION DEVICE

[76] Inventor: John D. Pickard, 9802 Longwood Cir., Louisville, Ky. 40223

[21] Appl. No.: 322,927

[22] Filed: Mar. 14, 1989

[51] Int. Cl.[4] ..... A63F 5/04; A63H 1/32

[52] U.S. Cl. ..... 273/141 R; 273/142 HA; 446/253

[58] Field of Search ..... 273/141 R, 142 HA; 446/253, 254

[56] References Cited

U.S. PATENT DOCUMENTS

| | | | |
|---|---|---|---|
| 717,230 | 12/1902 | Lough | 446/253 |
| 2,150,303 | 3/1939 | Walker | 273/142 HA |
| 4,163,556 | 8/1979 | Bertin | 273/142 HA X |

FOREIGN PATENT DOCUMENTS

| | | | |
|---|---|---|---|
| 651831 | 10/1937 | Fed. Rep. of Germany | 446/253 |

*Primary Examiner*—Anton O. Oechsle

*Attorney, Agent, or Firm*—Edward M. Steutermann

[57] ABSTRACT

A random determination device includes a generally circular central planar element having an indicating device located thereon where the outer circumference of the central element is generally circular except for inset lobes and where the central element is received in the opening in an annular element having choices indicated around the periphery so the indicating device of the central element can selectively point to various choices and where notches are provided in the periphery of the central element and adapted to receive clutch means and where the notches of the central element are shaped so that upon relative rotation of the central element and the outer element in one direction the clutch means engage the inner periphery of the outer element and prevent relative movement of the central and outer elements and upon rotation in the opposite direction the clutch means recess into the notches out of engagement with the outer element to allow rotation of the outer element on the inner element.

1 Claim, 2 Drawing Sheets

RANDOM SELECTION DEVICE

BACKGROUND OF THE INVENTION

The present invention relates, in general, to random selection device and more particularly relates to a random selection device of the torsion string type. Many examples of pull string or torsion string type devices are known in the art but such devices have had relatively short periods of popularity and have been utilized principally as curiosity devices or devices for providing optical illusions.

The prior art has included devices such as U.S. Pat. No. 4,189,862 which provides an action toy to operate a centrifugal top to spin at high speeds in single direction determined by the initial movement of the device. Likewise U.S. Pat. No. 3,672,094 provide an exercise device. utilizing the torsion spin principle. U.S Pat. No. 3,402,504 provide a wind up type toy using torsion spin principles but substantially different from devices within the scope of the present invention. Likewise U.S. Pat. No. 3,501,860 teaches a toy having a string actuated disc surrounded by transparent globe with a rubber band attached to a central element to provide a pleasing visual result. U.S. Pat. No. 3,052,060 teaches a toy which by torsion spinning causes an engagement between a spark producing and a second element which causes sparks. U.S. Pat. No. 2,595,990 teaches an arrangement again providing a visual effect in response to spinning of a device in association with a torsion string. None of the prior art teaches or even remotely suggests an arrangement as taught by the present invention directed to a random selection device wherein clutch mechanism of the type utilized herein is provided.

Most prior art related to random selection is currently directed to electronic random selection devices of the type generally known. Prior to the utilization of electronic random selection devices most chance selection arrangement where in the form of dice or other such means.

SUMMARY OF THE INVENTION

The present invention provides new, useful, and novel random selection devices which utilize the principal of torsion string rotation with two relatively moveable elements to provide a selection. Devices within the scope of the present invention are easily and economically fabricated, particularly in large volume and can be utilized for multiple applications.

Devices within the scope of the present invention use a unique free wheeling one way clutch where the outer portion of the device spins in one way and comes to a stop after the pulling action of the strings has stopped and generally in the rewind operation the clutch prevents reverse rotation of the outer element with reference to the central element. Devices can be fabricated and different program disks provided depending upon the particular application of the device for example, playing card faces can be utilized as well as numbers or other multiple choice solutions.

More particularly, the present invention provides a random determination device including a central planar element having an indicating device located thereon where the outer circumference of the central element is generally circular except for inset notches and where the central element is received in an annular element having choices indicated thereon so the indicating device of a central element can selectively point to various choices and where the central element is received within an outer element and where clutch means are received within the notches of the central element and are shaped so that upon relative rotation of the central element and the outer element in one direction the clutch means engages the inner periphery of the outer element to prevent relative movement of the central and outer elements to accelerate the rotation of the outer element and upon rotation in the opposite direction the clutch means recess into the notches out of engagement with the outer element to allow freedom of indepent rotation by the outer element.

One example within the scope of the present invention is illustrated in the accompanying drawings and described hereinafter but it will be understood that the illustration and the descriptions herein are by way of example only and that various arrangements also within the scope of the present invention will occur to those skilled in the art upon reading the disclosure set forth hereinafter.

BRIEF DESCRIPTION OF THE DRAWINGS

In examples in accordance with the present invention illustrated herein.

DETAILED DESCRIPTION OF THE INVENTION

Figure 3:
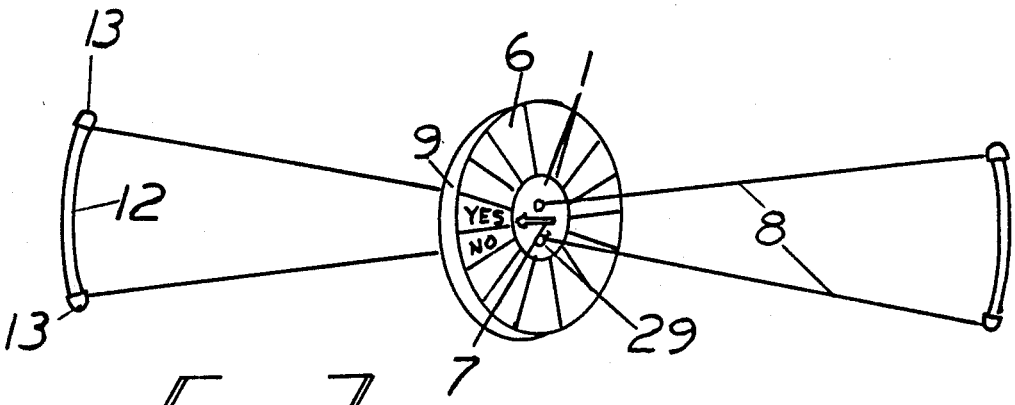
FIG. 3 is a view of a fully assembled arrangement within the scope of the present invention.

Referring to Figures in general, it will be noted that the devices within the scope of the present invention provide a free wheeling one way clutch arrangement where the outer portion of a two part spinning disk is made to spin and coast to stop after the operator has stopped the receptacle pulling action on the strings illustrated in FIG. 3 with one last continuous hard pull.

The strings that operate the toy pass through a central assembly where indexing arrows can be carried on one or both sides of the assembly. The arrows can be directed opposite to each other or in any other configuration and can point to the same or different position on the circumference of the outer element when the spinning stops in any case the indexing arrow points to one of the segments of the program disk inserts and the program disk may contain information of many types. For example the disk on one side of the device may contain educational questions and on the other side may contain answers to these questions. In another example it would be symbols and words involved in games of chance such as card games, dice, or even an executive decision maker toy with answers such as "YES", "NO", "LATER", "MAYBE", etc., inprinted on the program disk. This could also be available with blank spaces for custom programing by the user.

The flexibility of the devices within the scope of the present invention allows exercising of imagination and creativity.

Figure 1:
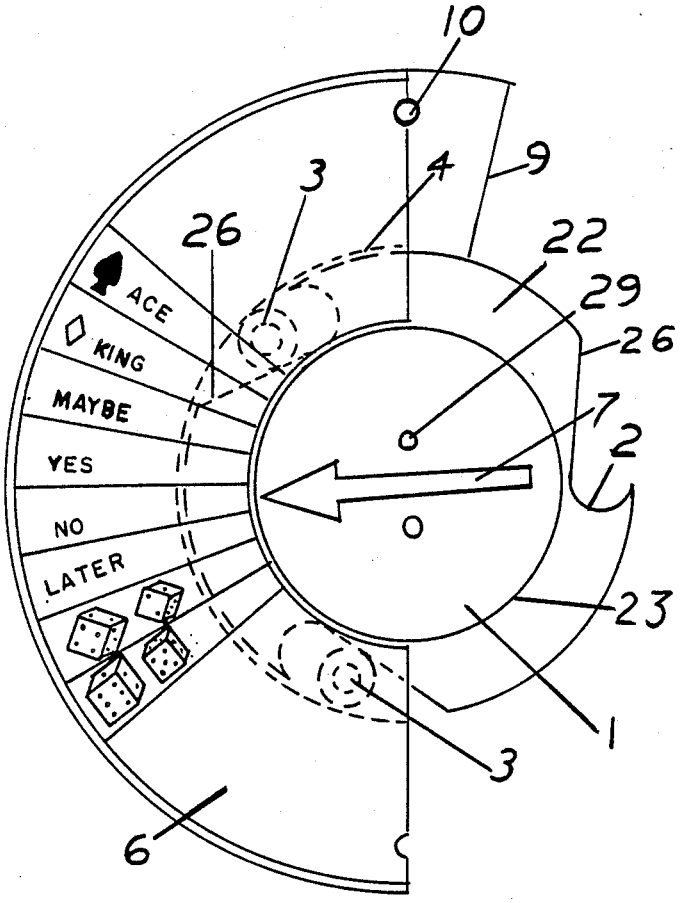
FIG. 1 is a partial view of an arrangement within the scope of the present invention in assembled form.
Figure 2:
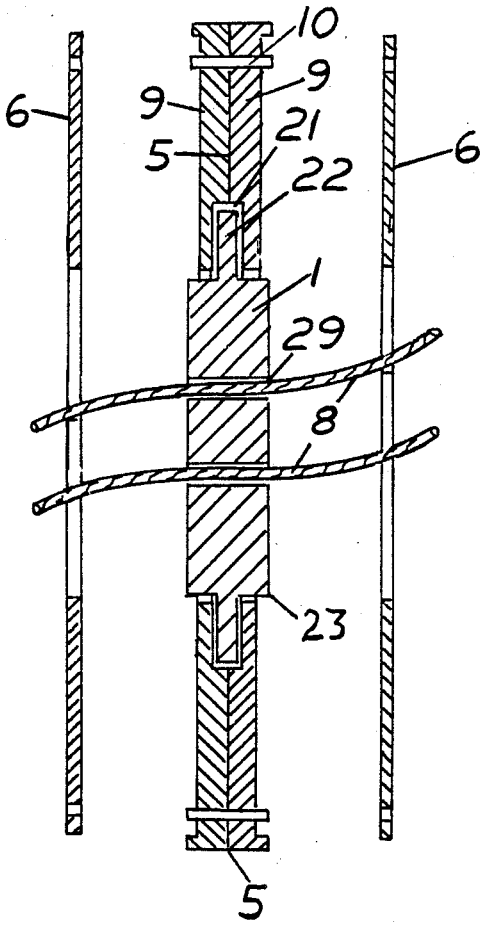
FIG. 2 is a view taken along a plane passing through of line 2—2 FIG. 1.

According now to FIG. 1 a portion of an example of a device within the scope of the present invention is illustrated where outer annular shaped element 9 is provided comprising as shown in FIG. 2, two planar annular pieces of material, such as plastic, which can be secured together by means of a securing device 10 which also acts as an index for a program disk as described hereinafter where there is a separation 5 between the two elements 9. A groove 21 is provided as shown in the element 9 to receive a flange 22 of a central element 1 where the central element 1 is provided with notches 2 in flange 22 as shown in FIG. 1. It will be understood the central element 1 can rotate freely within the groove 21 of annular elements 9 and outwardly extending shoulders 23 are provided on each side of the element 1 to maintain alignment of the element within annular rings 9.

The notches 2 are adapted to receive free moving clutch means 3 where the diameter of the clutch means 3 are slightly less than the diameter of the notch 2 so that when the clutch means 3 is received fully in the notch 2 there is no engagement between the clutch means 3 and the inner surface 4 of the elements 9. On the contrary when the clutch means 3 are thrown outwardly, as for example by the centrifugal force generated by the centrifugal acceleration of the element the clutch means 3 engage the inner surface 4 of the elements 9 to prevent relative rotation between the central element 1 and the outer element 9. This occurs when the central element rotates in a first direction where the purpose of such rotation is to give the outer ring elements 9 a degree momentum. As the strings are relaxed to rotate the element 1 in the opposite direction the clutch means 3 move down the ramp 26 provided in each notch 2 to be received in recess notch 2 out of engagement with the inner surface 4 and allow the outer rings 9 to rotate freely about the inner element 1 while the string is being rewound.

Referring to FIG. 2 an arrangement of the type shown in FIG. 1 is illustrated in crosssection and the program disks 6 are shown separated from the elements 9 to be received by the securing device 10. As also shown string sections 8 are received through holes 29 in element 1 to cause rotation of element 1 and elements 9 in one direction when clutch means 3 engage surface 4 and allow rotation of the assembled elements 9 and element 1 in opposite directions when the clutch means are disengaged.

Figure 4:
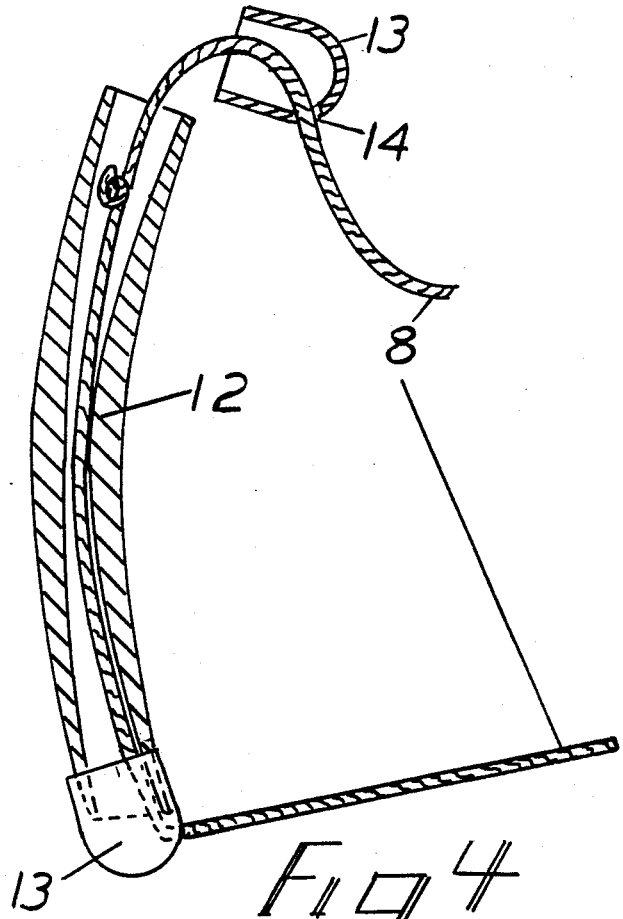
FIG. 4 is a cross sectional view of an example of a handle element within the scope of the present invention.

FIG. 3 is an illustration of the device shown in FIG. 1 where string 8 is shown received through holes 29 in the central element 1. The arrow 7 is also shown in FIGS. 1 and 3. As shown in FIG. 4, the handle elements are thicker in the middle and diminish in thickness toward the ends to allow adjustment of bending moment to compensate for pulling force on the handle to prevent kinking of the handle and provided lively action.

Handles 12 are provided on opposite sides of the string 8 and as shown in FIG. 4 the handles can be generally curved in shape or can be straight molded flexible tubing. The string knot can be located in the handle to prevent any interference of the knot or other fastening device with operation of the device.

Caps 13 can be provided to be received over the ends of the handle elements 12 and have apertures 14 therein located in the side for passage of the string 8. The light mass of the handle 12 and the soft end caps 13 further prevent a likelihood of injury to the operator.

The Invention of claimed is:

1. A random determination device including a central planar element having an indicating device located thereon where the periphery of the central element is generally circular except for at least one inset lobe means where the central element is received in an outer annular element having choices indicated around the periphery thereof by means of replacable program disk inserts so the indicating device of the central element can selectively point to various choices and where the central element is received within a central opening of said outer element and where clutch means are received within said lobe of the central element and where said least one lobe of said central element are shaped so that upon relative rotation of the central element and the outer element in one direction the clutch means engage the inner periphery of the outer element and prevent relative movement of the central and outer elements and upon rotation in the opposite direction the clutch means recede into the at least one lobe out of engagement with the outer element.

* * * * *